US008653922B2

(12) United States Patent
Flaceau

(10) Patent No.: US 8,653,922 B2
(45) Date of Patent: Feb. 18, 2014

(54) ELECTROMECHANICAL RELAY HOUSING, RELAY, SWITCHING ASSEMBLY AND ELECTROMAGNETIC RELAY SUPPORT ASSEMBLY

(71) Applicant: Radiall, Rosny Sous Bois (FR)

(72) Inventor: Alexandre Flaceau, Lyons (FR)

(73) Assignee: Radiall, Rosny Sous Bois (FR)

( * ) Notice: Subject to any disclaimer, the term of this patent is extended or adjusted under 35 U.S.C. 154(b) by 0 days.

(21) Appl. No.: 13/780,159

(22) Filed: Feb. 28, 2013

(65) Prior Publication Data

US 2013/0222085 A1 Aug. 29, 2013

(30) Foreign Application Priority Data

Feb. 28, 2012 (FR) ..... 12 51805
Oct. 29, 2012 (FR) ..... 12 60295

(51) Int. Cl.
*H01F 1/00* (2006.01)
*H01F 3/00* (2006.01)

(52) U.S. Cl.
USPC ..... 335/277; 335/202

(58) Field of Classification Search
USPC ..... 335/104, 192, 202, 248, 277, 157, 158, 335/257
See application file for complete search history.

(56) References Cited

U.S. PATENT DOCUMENTS

| | | | | |
|---|---|---|---|---|
| 2,268,882 A | | 1/1942 | Lilja | |
| 2,609,171 A | * | 9/1952 | Knapp et al. | 248/574 |
| 3,800,251 A | * | 3/1974 | Usui et al. | 335/131 |
| 3,863,881 A | * | 2/1975 | Fletcher et al. | 248/634 |
| 4,382,587 A | * | 5/1983 | Heinrich et al. | 267/160 |

FOREIGN PATENT DOCUMENTS

| | | | |
|---|---|---|---|
| DE | 741838 C | | 11/1943 |
| JP | 2003152286 A | * | 5/2003 |
| JP | 2006-155972 A | | 6/2006 |

OTHER PUBLICATIONS

French Search Report dated Nov. 15, 2012, which issued during the prosecution of French Patent Application No. 1251805, to which the present application claims priority.

* cited by examiner

*Primary Examiner* — Bernard Rojas
(74) *Attorney, Agent, or Firm* — Troutman Sanders LLP

(57) ABSTRACT

A housing designed to house an electromagnetic relay comprises a switching member including electrical contact switching pieces, able to move in translation along a principal direction. The housing has a hollow body receiving the switching member, elements fixing the body to a support. The fixing elements each include a fixing part having a surface bearing on the support and means of fixing to the support. The fixing elements further have a connection part connecting the fixing part to the body and the connection parts are designed so as to deform in flexion at least along the main direction.

15 Claims, 13 Drawing Sheets

ELECTROMECHANICAL RELAY HOUSING, RELAY, SWITCHING ASSEMBLY AND ELECTROMAGNETIC RELAY SUPPORT ASSEMBLY

CROSS-REFERENCE TO RELATED APPLICATIONS

The present application claims priority to French Patent Application Nos. 1251805 filed Feb. 28, 2012, and 1260295 filed Oct. 29, 2012. Both applications are incorporated herein by reference.

FIELD OF INVENTION

The present invention concerns an electromechanical relay housing, an electromechanical relay comprising such a housing, and a switching assembly comprising several electromechanical relays. The invention also concerns an electromagnetic relay support assembly.

BACKGROUND

Within the meaning of the present invention, an electromechanical relay is a device for switching electrical contacts. The invention concerns more particularly the electromechanical relays designed to function in the field of microwave-frequency signals, which have a frequency above 1 GHz.

A relay consists of a housing that contains a switching member comprising at least one electromagnetic actuator which, when it is supplied by an electrical control signal, selectively establishes an electrical contact between several electrical inputs by means of a movable part.

The switching members of electromechanical relays thus comprise movable parts able to move in a translation or rotation movement. In certain conditions of use, for example in the space, telecommunications, instrumentation, aeronautical or solar fields, the relays are subjected to vibrations and/or shocks liable to establish or cut the electrical contacts by error. For example, the relays installed in a satellite are subject to high vibrations when the spacecraft takes off or when the satellite is put in orbit and, during the spreading of the solar panels of the satellite, the relays are subjected to shocks that may reach an intensity equivalent to an acceleration of 6000 g.

Mounting such a switching member in a housing comprising means of fixing to a support is known. To attenuate the shocks and/or vibrations, JP-A-2006-155972 proposes interposing silent blocks, for example silicone washers, between fixing screws and the support. The silent blocks are relatively heavy, which is not advantageous, in particular in the aerospace field where it is sought to lighten the equipment sent into space to the maximum extent. Moreover, the synthetic materials used for manufacturing silent blocks do not in a satisfactory manner transmit the heat generated by the relay to the support to which it is fixed. This is particularly disadvantageous in particular for space equipment since, when the relays are situated in a vacuum, the heat can dissipate solely by conduction, through the points of contact between the housing and the support.

As an alternative, in order to damp the shocks and/or vibrations, equipping a switching member with movable masses is known. The movable masses are disposed so as to form a counterweight with the movable parts that provide the switching of the electrical contacts. The balancing of the movable masses, in order to compensate for the dynamic effects of movement of the movable switching parts, is difficult and tricky to establish. In addition, the counterweights are articulated with the moving pieces of the switching member and these articulations have a functional clearance allowing movement thereof. During shocks of high density, the movable pieces may move and cause uncovenanted and unwanted switching of the product.

It is these drawbacks that the invention is particularly intended to remedy by proposing a housing for fixing electromechanical relays that is lightweight and of simple design and dissipates the heat generated by the relay to a fixing support of the housing.

SUMMARY

To this end, the subject matter of the invention is an electromechanical relay housing, the relay comprising a switching member including pieces for switching electrical contacts, movable in translation on a principal direction, the housing has a hollow body for receiving the switching member, and elements for fixing the body to a support.

The fixing elements each include a fixing part having a surface bearing on the support and means of fixing to the support. The fixing elements also include a connection part connecting the fixing part to the body and the connection parts are designed to deform in flexion at least on the principal direction, that is to say in a direction parallel to the movement of the movable pieces of the relay.

By virtue of the invention, the connection parts of the fixing elements of the housing deform in flexion when the relays are subjected to forces resulting from impacts and/or vibrations, which attenuates these forces, by damping, and thus prevents the electrical contacts of the switching member from switching accidentally. Such a housing is lightweight, of simple design and inexpensive to manufacture. This housing also satisfactorily transmits the heat generated by the switching member to the fixing support, by allowing direct contact between the fixing elements and support, without requiring the addition of damping pieces such as silent blocks.

According to examples of the invention, such an electromagnetic relay housing may incorporate one or more of the following features, taken in any technically acceptable combination. The body is cylindrical and extends along a longitudinal axis parallel to the principal direction. The body is cylindrical and extends along a longitudinal axis perpendicular to the principal direction. The housing is monolithic, the body and fixing elements being formed in a single piece. The body is cylindrical and extends along a longitudinal axis and the bearing surfaces of the fixing parts are parallel to the longitudinal axis of the body. The body is cylindrical and extends along a longitudinal axis and the bearing surfaces of the fixing parts are perpendicular to the longitudinal axis of the body. The transverse section of at least one portion of the connection part of each fixing element is elongate in shape and has a width, measured parallel to the principal direction, less than the length of this transverse section.

The housing includes a first fixing element extending from a first side of a mid-plane of the body, and two second fixing elements situated opposite to the first fixing element with respect to the mid-plane. A maximum width of the first fixing element is less than a minimum distance between the second fixing elements.

The invention also concerns an electromagnetic relay, having a switching member housed in the housing as described above.

The invention also concerns a switching assembly, including several housings fixed to a support so that the first fixing element of a first housing is placed between the second fixing elements of an adjacent second housing.

The invention also concerns an electromagnetic relay support assembly, which includes such a housing and in addition at least one element for damping shocks and vibrations of the housing body with respect to the support, produced from an elastomer.

Thus, the damping elements work, in particular, in compression when the relay is subjected to forces resulting from shocks and/or vibrations. These damping elements attenuate the stresses that remain in the housing despite the fixing elements, and also prevent the electrical contacts of the switching member from switching accidentally.

According to examples of the invention, such an electromagnetic relay support assembly may incorporate one or more of the following features, taken in any technically acceptable combination. The damping element is stressed mechanically, in particular in compression, when the body of the housing moves with respect to the support along the principal direction. A rigid element is interposed between the damping element and the support. The rigid element is interposed between the bearing surface of the fixing elements and the support. The rigid element comprises at least one hollow support in which the damping element is disposed.

According to other examples of the invention, each damping element can be annular and mounted around a stud projecting with respect to the hollow body, inside a support that surrounds this damping element. Each damping element can be disposed in a support outside a space delimited by the fixing elements. The damping elements can be disposed on either side, on the principal axis, of a fixing part belonging to the fixing elements.

BRIEF DESCRIPTION OF THE DRAWINGS

The invention will be better understood and other advantages thereof will emerge more clearly in the light of the following description of six examples of a relay housing and four examples of a relay support assembly, given solely by way of example and made with reference to the accompanying drawings, in which.

DETAILED DESCRIPTION

Figure 1:
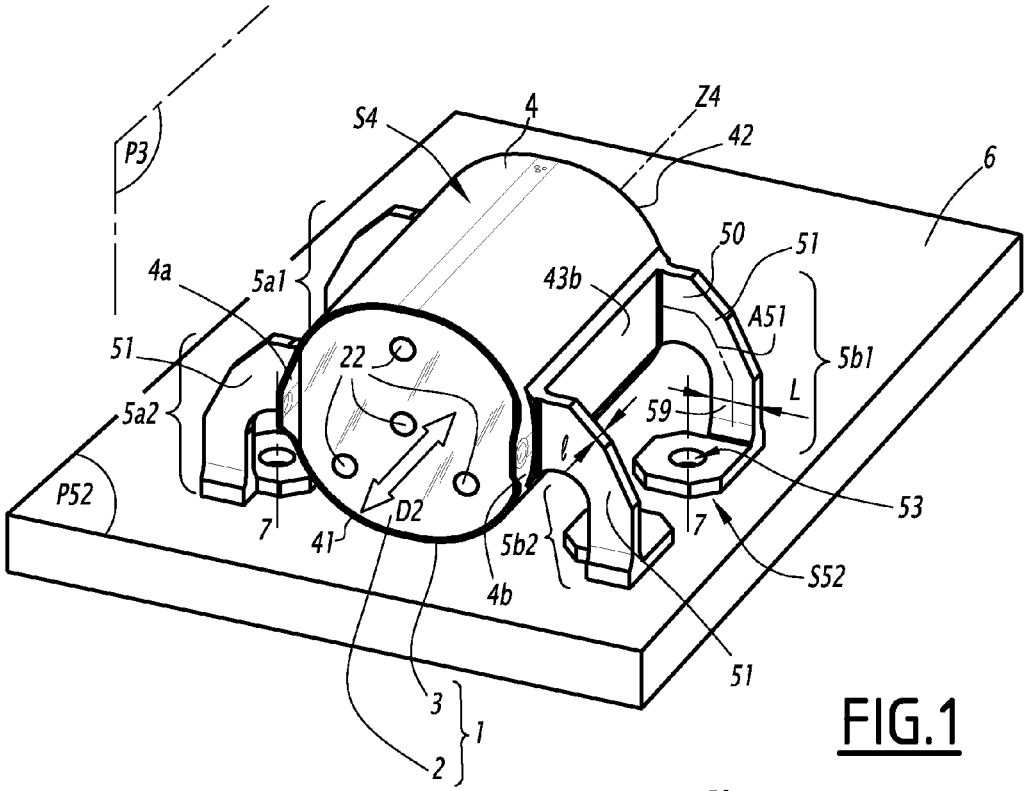
FIG. 1 is a perspective view of an electromechanical relay according to the invention, comprising a relay housing fixed to a support.
Figure 2:
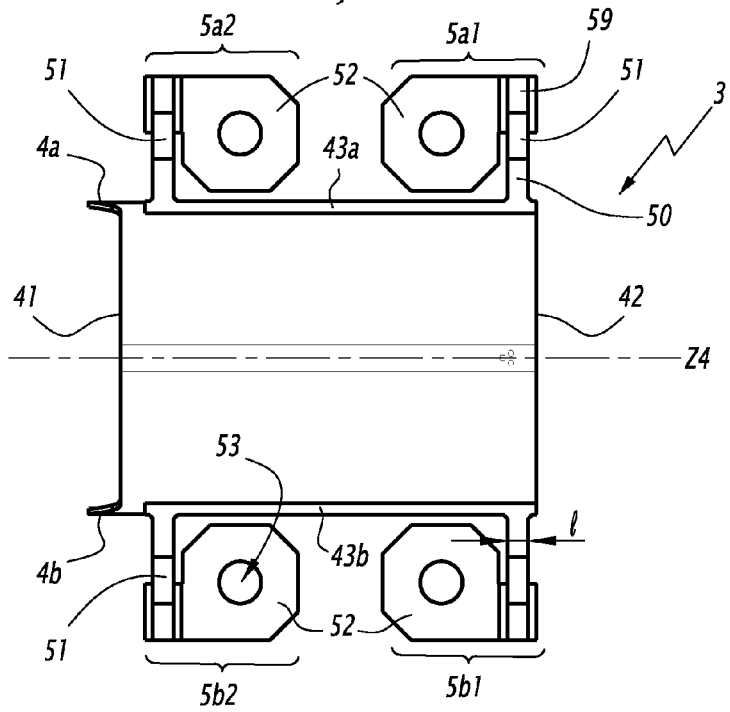
FIG. 2 is a plan view of the electromechanical relay of FIG. 1.
Figure 3:
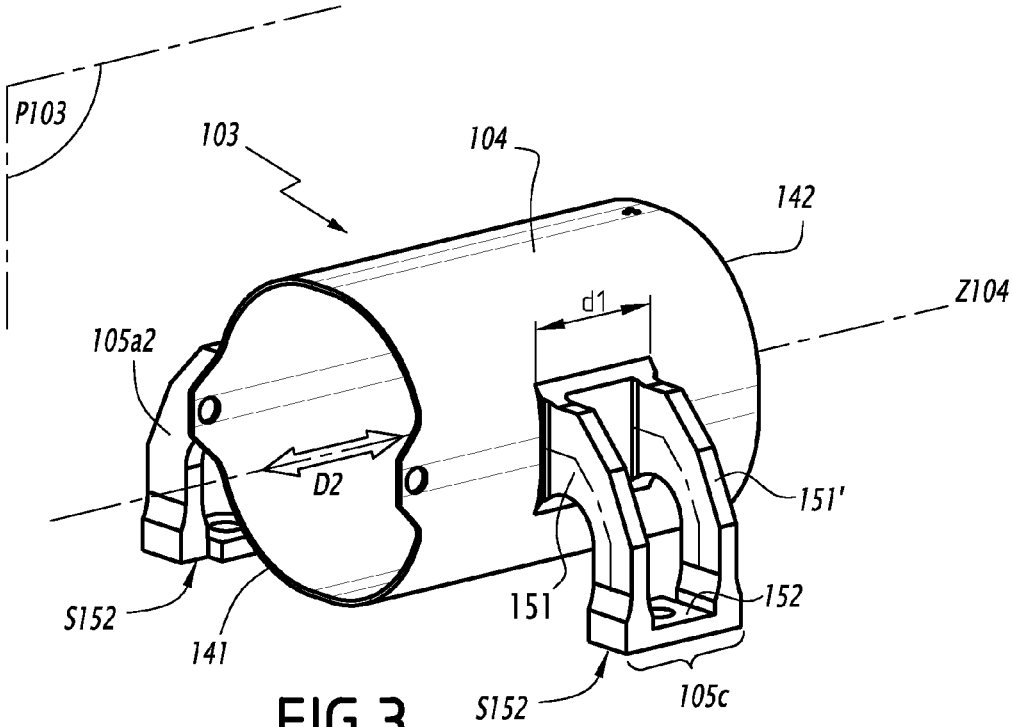
FIG. 3 is a perspective view of a relay housing according to another example.
Figure 4:
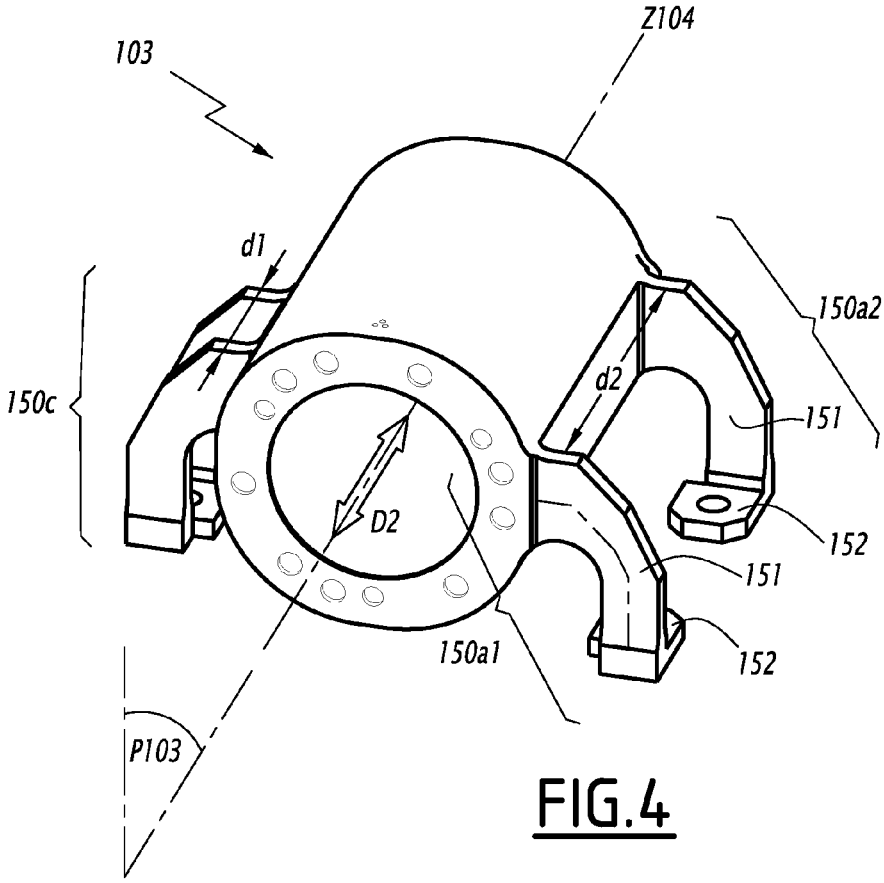
FIG. 4 is a perspective view, at another angle, of the housing of FIG. 3.

FIGS. 1 and 2 show an electromechanical relay 1 having a housing 3 and a switching member 2 roughly cylindrical in shape with a circular cross section. The switching member 2 has several electrical connection sockets 22, provided for connecting electrical cables for transmitting electrical input and output signals, and more particularly microwave-frequency signals that have a frequency greater than 1 GHz. The housing 3 includes a hollow body 4 inside which the switching member 2 is housed. The body 4 is cylindrical with a circular cross section and extends along a longitudinal geometric axis Z4. A first longitudinal end 41 of the body 4 is open and the second longitudinal end 42 of the body 4 is closed by a circular bottom. The open end 41 of the body 4 can include two pierced lugs 4*a* and 4*b* provided for fixing the switching member 2 to the housing 3.

The external lateral surface S4 of the body 4 includes two diametrically opposed structural reinforcements 43*a* and 43*b* forming an external protrusion extending over the length of the body 4, parallel to the axis Z4, between the ends 41 and 42.

The housing 3 includes four elements 5*a*1, 5*a*2, 5*b*1 and 5*b*2 for fixing the body 4 to a support 6. Each fixing element 5*a*1, 5*a*2, 5*b*1 and 5*b*2 includes a connection part or lug 51 and a fixing part 52. The lugs 51 each connect one of the longitudinal ends of one of the reinforcements 43*a* or 43*b* to the fixing part 52 of the corresponding fixing element 5*a*1, 5*a*2, 5*b*1 or 5*b*2.

The housing 3 can symmetrical with respect to a mid-plane P3 that passes through the axis Z4, between the fixing elements 5*a*1 and 5*a*2 on the one hand and the fixing elements 5*b*1 and 5*b*2 on the other hand. Thus the fixing elements 5*a*1 and 5*b*1 on the one hand and the fixing elements 5*b*1 and 5*b*2 on the other hand can diametrically opposed.

The fixing parts 52 each comprise a bearing surface S52 placed on the support 6. The bearing surfaces S52 of the fixing elements 5*a*1, 5*a*2, 5*b*1 and 5*b*2 are in direct contact with the support 6. Consequently the transmission of heat between the housing 3 and the support 6 is optimised, which makes it possible to discharge the heat generated by the switching member 2.

The bearing surfaces S52 are coplanar and extend in a bearing plane P52 perpendicular to the mid-plane P3 and parallel to the axis Z4. Each fixing part 52 includes a central hole 53 for passage of a fixing element 7 such as a screw, represented solely by its axis in FIG. 1. The holes 53 and the screws 7 thus constitute means of fixing the housing 3 to the support 6. When the housing 3 is fixed to a flat horizontal support 6, the axis Z4 of the body 4 extends horizontally.

The lugs 51 each extend along a geometric axis A51 forming an elbow, in a plane perpendicular to the axis Z4. Each lug 51 includes a proximal part 50 that is connected to the end of one of the reinforcements 43*a* or 43*b* and extends lateral outwards, perpendicular to the mid-plane P3, as well as a distal part 59 connected to the proximal part 50 on the one hand and the fixing part 52 on the other. The distal part 59 of each fixing element 5*a*1, 5*a*2, 5*b*1 and 5*b*2 extends perpendicular to the bearing plane P52.

The transverse section of each lug 51, in a plane perpendicular to the axis A51, is roughly rectangular and has two sides of small dimension having a width l as well as two sides of large dimension having a length L greater than the width l. The width l of each section, along an axis A51, is oriented parallel to the axis Z4 and the length L of each section extends in a plane perpendicular to the axis Z4. These lengths L and l may vary along the lug 51 so as to distribute the mechanical forces undergone during deformation.

The switching member 2 includes at least one movable part, not visible in FIG. 1, such as an electromagnetic actuator which, when it is supplied by an electrical control signal, establishes an electrical contact between some of the electrical inputs of the switching member 2. In service, these movable parts move in translation on a principal direction D2 parallel to the axis Z4 in both directions. When the switching member 2 is subjected to a shock and/or vibrations, the shock and/or vibrations risk moving the movable parts into a wrong position causing accidental switching of the member 2.

The geometry of the fixing elements 5*a*1, 5*a*2, 5*b*1 and 5*b*2 is designed to attenuate the transmission of shocks and/or vibrations between the support 6 and the body 4, on particular on the principal direction D2, that is to say parallel to the axis Z4. The rigidity of the lugs 51 is smaller in the direction Z4 than perpendicular to the axis Z4. This is because the width l of the cross section of the lugs 51 is oriented parallel to the axis Z4 and the length L of the lugs 51 is oriented in a plane perpendicular to the axis Z4. Consequently the lugs 51 deform in flexion, in the direction of axis Z4, when they are subjected to a force parallel to the axis Z4, in particular to a force resulting from impacts and/or vibrations. On the other hand, the lugs 51 are relatively rigid when they are subjected to a force extending in a plane perpendicular to the axis Z4, for example a force perpendicular to the mid-plane P3. The lugs 51 thus dissipate the mechanical energy of the shocks and/or vibrations while preventing the transmission of this energy to the body 4 of the housing 3. In this way, the risks of accidental switching of the switching member 2 are attenuated.

FIGS. 3 to 22 illustrate relay housings 103, 203, 303, 403, 503, 603, 703, 803 and 903 respectively in accordance with numerous examples of the invention, where the elements similar to those of the above example bear the same numerical references, respectively increased by 100, 200, 300, 400, 500, 600, 700, 800 and 900.

Thus each housing 103, 203, 303, 403, 503, 603, 703, 803 and 903 includes a hollow body 104, 204, 304, 404, 504, 604, 704, 804 or 904 inside which a switching member is housed, similar to the switching member 2. Each body 104, 204, 304, 404, 504, 604, 704, 804 and 904 is cylindrical with a circular cross section and extends along a longitudinal geometric axis Z104, Z204, Z304, Z404, Z504, Z604, Z704, Z804 or Z904. A first longitudinal end 141, 241, 341, 441, 541, 641, 741, 841 or 941 of the body is open and the second longitudinal end 142, 242, 342, 442, 542, 642, 742, 842 or 942 of the body is closed by a circular bottom.

Hereinafter, the elements of the housings 103, 203, 303, 403, 503, 603, 703, 803 and 903 similar to the housing 3 are not described again.

Unlike the body 4 of the housing 3 in FIGS. 1 to 2, the body 104 of the housing 103 is fixed to a support 106 by means of three fixing elements 105*a*1, 105*a*2 and 105*c* instead of four. The fixing elements 105*a*1 and 105*a*2 are similar to the fixing elements 5*a*1 and 5*a*2 and each comprise an angled lug 151 and a fixing part 152. The fixing elements 105*a*1 and 105*a*2 are situated on a first side of a mid-plane P103 passing through the axis Z104 and the fixing element 105*c* is opposite to the fixing elements 105*a*1 and 105*a*2 with respect to the mid-plane P103.

The fixing element 105*c* can have two identical angled lugs 151 and 151' that each connect the body 104 to a single fixing part 152, the surface of which bearing against the support 106 is denoted S152.

The lugs 151 and 151' of the fixing element 105*c* are closer to each other than the lugs 151 of the fixing elements 105*a*1 and 105*a*2. More particularly, the maximum distance d1 between the surfaces of the lugs 151 and 151' of the fixing element 105*c* turned opposite each other is strictly less than the minimum distance d2 between the surfaces of the lugs 151 of the fixing elements 105*a*1 and 105*a*2, turned facing each other. In addition, the minimum distance d2' between the fixing parts 152 of the fixing elements 105*a*1 and 105*a*2 is strictly greater than the maximum width L152 of the fixing part 152 of the fixing element 105*c*. The distances d1, d2, d2' and the width L152 are measured parallel to the axis Z104.

The functioning of the housing 103 is similar to that of the housing 3, the lugs 105*a*1, 105*a*2 and 105*c* being designed to deform in flexion along the axis Z104.

Figure 5:
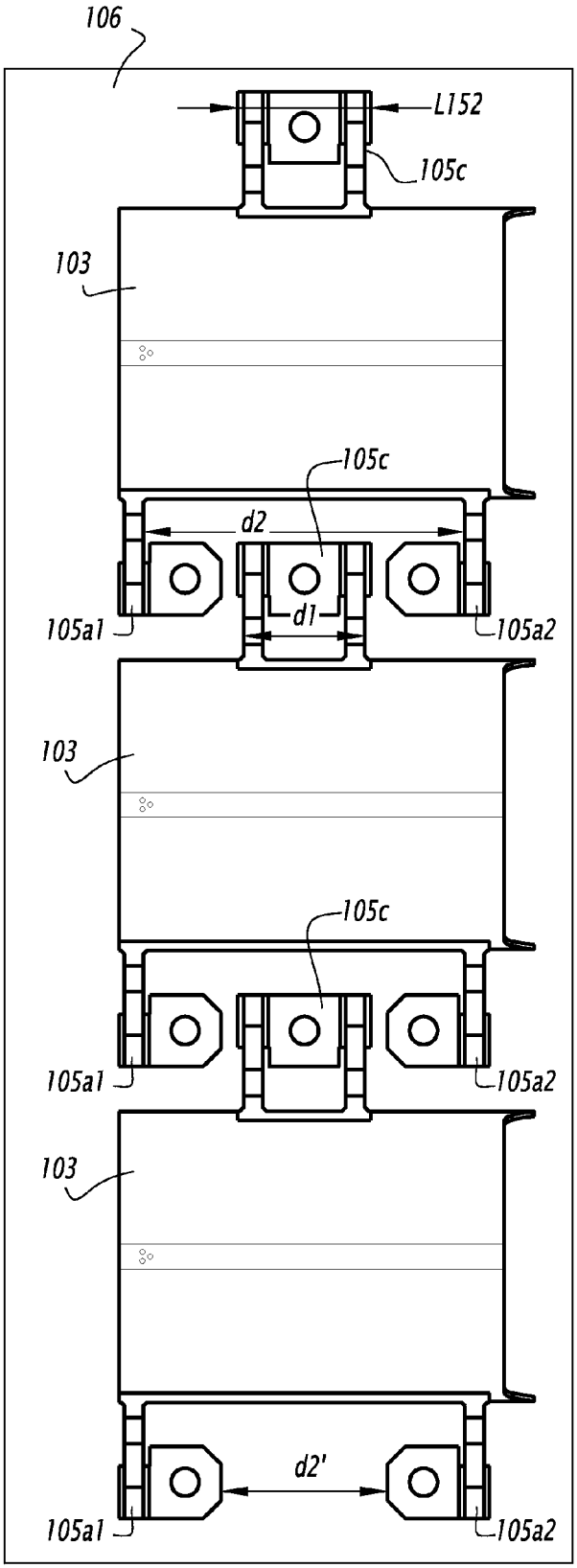
FIG. 5 shows a switching assembly, commonly referred to as a matrix, having three relay housings similar to the one in FIG. 3, fixed to a support.

In FIG. 5, several housings 103 are fixed to a support 106, alongside one another, with the fixing element 105*c* of a first housing 103 disposed between the fixing elements 105*a*1 and 105*a*2 of an adjacent second housing 103, the longitudinal axes Z104 of the housings 103 being placed parallel. It is thus possible to produce a compact matrix or connection assembly, comprising several relays.

Figure 6:
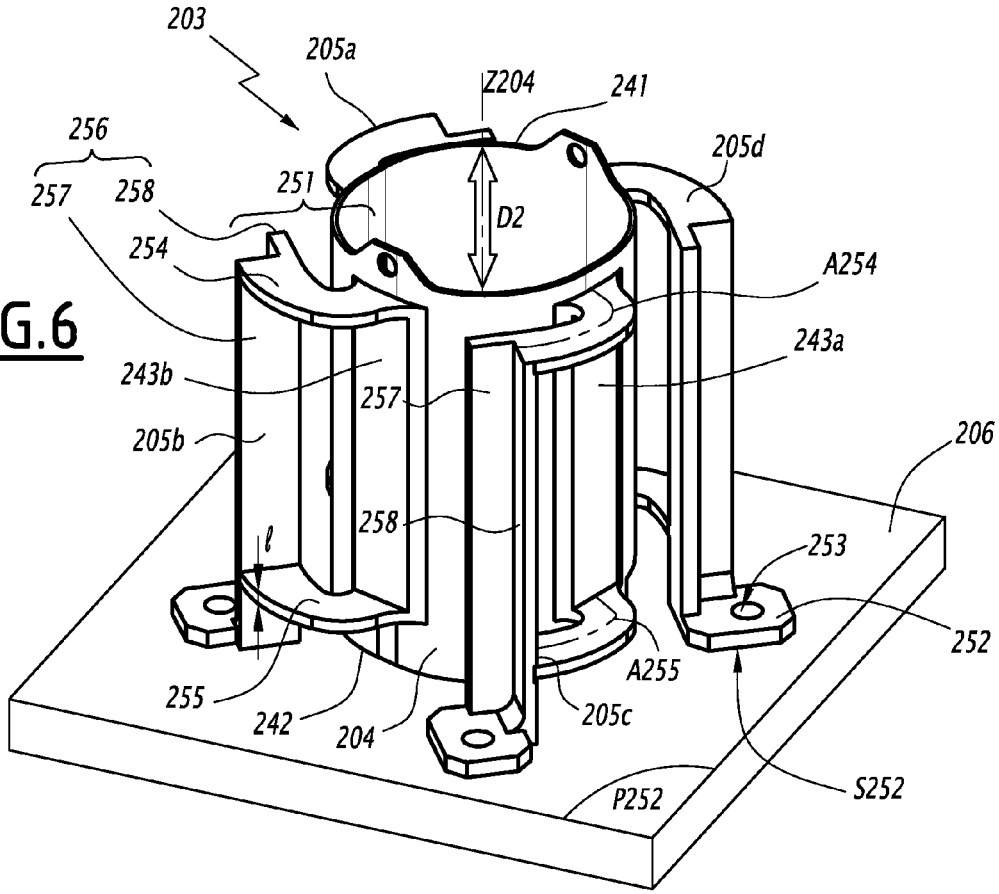
FIGS. 6 and 7 are perspective and plan views of a relay housing according to a further example.
Figure 7:
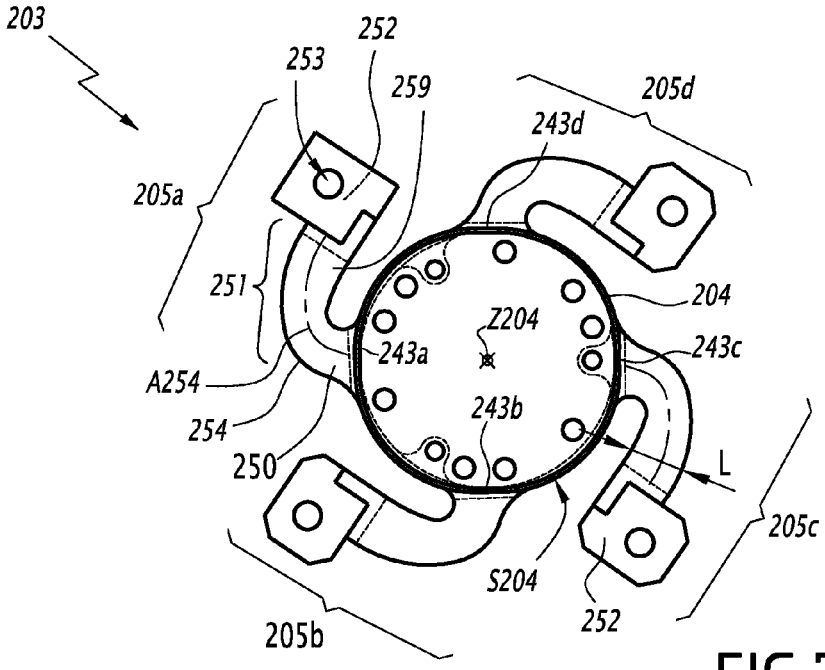

The external lateral surface S204 of the body 204 of the housing 203 shown in FIGS. 6 and 7 includes four structural reinforcements 234*a*, 243*b*, 243*c* and 243*d* offset angularly by 90° about the axis Z204, extending over the entire length of the body 204, parallel to the axis Z204, and forming a protrusion.

The housing 203 is fixed to a support 206 by means of four fixing elements 205*a*, 205*b*, 205*c* and 205*d* offset angularly by 90°, each connected to one of the reinforcements 234*a*, 243*b*, 243*c* and 243*d*. Each fixing element 205*a*, 205*b*, 205*c* and 205*d* includes a connecting part 251 and a fixing part 252. The connecting parts 251 each connect one of the longitudinal ends of one of the reinforcements 234*a*, 243*b*, 243*c* and 243*d* to the fixing part 252 of the corresponding fixing element 205*a*, 205*b*, 205*c* and 205*d*.

Each fixing element 252 includes a bearing surface S252 in contact with the support 206. The bearing surfaces S252 are coplanar and extend in a bearing plane P252. Each fixing part 252 includes a central hole 253 for passage of a fixing screw, not shown. Unlike the housings 3 and 103, the bearing surfaces S252 of the fixing elements 205*a*, 205*b*, 205*c* and 205*d* of the housing 203 are perpendicular to the longitudinal axis Z204 of the body 204. Thus, when the housing 203 is fixed to a horizontal support 206, the axis Z204 is vertical.

Each connection part 251 includes two angled lugs 254 and 255, as well as a longitudinal branch 256. The two lugs 254 and 255 of each connection element 251 are parallel and each connects one of the ends of the corresponding structural reinforcement 234*a*, 243*b*, 243*c* or 243*d* to the corresponding branch 256. Each branch 256 thus connects the corresponding two lugs 254 and 255 to the fixing part 252.

The lugs 254 and 255 each extend along a geometric axis A254 or A255 forming an elbow, in a plane perpendicular to the axis Z204. Each lug 254 and 255 includes a proximal part 250 that is connected to the end of one of the reinforcements

123*a*, 243*b*, 243*c* or 243*d* and extends radially outwards, as well as a distal part 259 connected to the proximal part 250 on the one hand and to the branch 256 on the other. The distal part 259 of each fixing element 205*a*, 205*b*, 205*c* and 205*d* extends in an orthoradial direction, in other words a circumferential direction.

The transverse section of each lug 254 and 255, in a plane perpendicular to the axis A254 or A255, is roughly rectangular and has two sides of small dimension having a width l, as well as two sides of large dimension having a length L greater than the width l. The width l of each section, along the axis A254 or A255, is oriented parallel to the axis Z204 and the length L of each section extends in a plane perpendicular to the axis Z204.

The transverse section of each branch 256, taken perpendicular to the axis Z204, is in a square or "L" shape and includes a first wall 257 that extends in an orthoradial direction, in line with the two lugs 254 and 255 of the corresponding fixing elements 205*a*, 205*b*, 205*c* or 205*d*. Each branch 256 also includes a second wall 258 extending in a radial direction, perpendicular to the first wall 257.

The switching member housed in the housing 203 includes at least one movable part, not shown, which, when it is supplied by an electrical control signal, selectively establishes an electrical contact between several electrical inputs. In service, these movable parts move in translation on a principal direction D2 parallel to the axis Z204, in both ways. When the housing 202 is subjected to a shock and/or to vibrations, the shock and/or vibrations risk moving the movable parts into a wrong position, causing the accidental switching of the switching member 202.

The geometry of the fixing elements 205*a*, 205*b*, 205*c* and 205*d* is designed to attenuate the transmission of the shocks and/or vibrations between the support 206 and the body 204, in particular on the principal direction D2 of movement of the movable parts, that is to say along the axis Z204. This is because the width l of the cross section of the lugs 254 and 255 is oriented parallel to the axis Z204 and the length L of the lugs 254 and 255 is oriented in a plane perpendicular to the axis Z204, and consequently the lugs 254 and 255 deform in flexion, in the direction of the axis Z204, when they are subjected to a force parallel to the axis Z204, in particular to a force resulting from shocks and/or vibrations. The lugs 254 and 255 this dissipate the mechanical energy of the shocks and/or vibrations, preventing the transmission of this energy to the body 204 of the housing 203. In this way, the risks of accidental switching of the switching member are attenuated.

Figure 8:
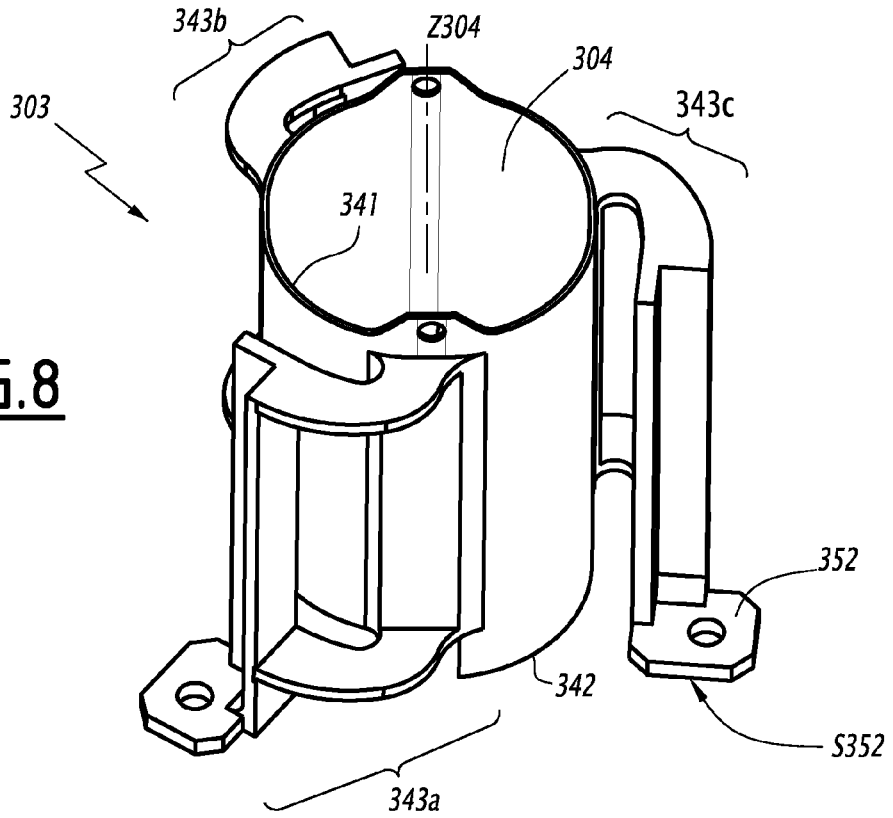
FIGS. 8 and 9 are perspective and plan views of a relay housing according to a yet further example.
Figure 9:
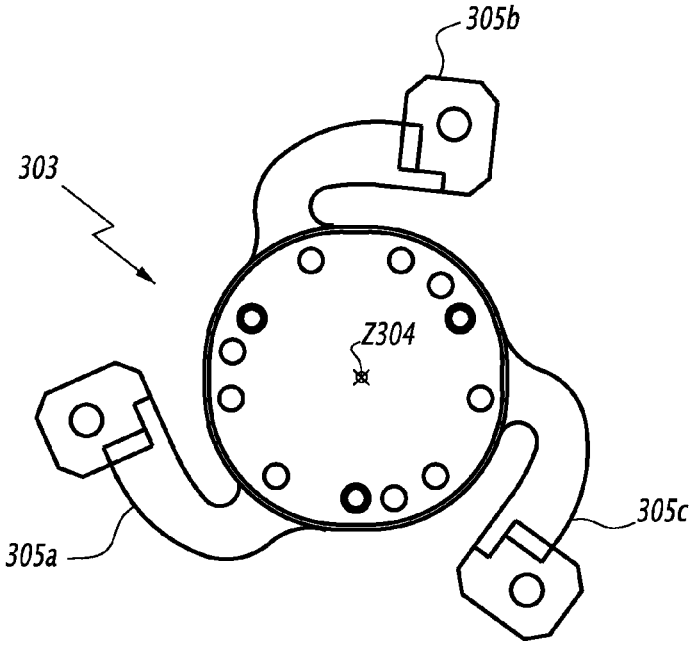

The housing 303 shown in FIGS. 8 and 9 is similar to the housing 203 in FIGS. 6 and 7 except that the housing 303 includes three fixing elements 305*a*, 305*b* and 305*c* instead of four, offset angularly by 120° about the axis Z304 and each connected to the body 304 of the housing 303. The fixing elements 352 have, as in the previous embodiment, surfaces S352 bearing against a support that are perpendicular to the axis Z304.

The functioning of the housing 303 is similar to that of the housing 203, the lugs 305*a*, 305*b* and 305*c* being designed to deform in flexion along the axis Z304.

Figure 10:
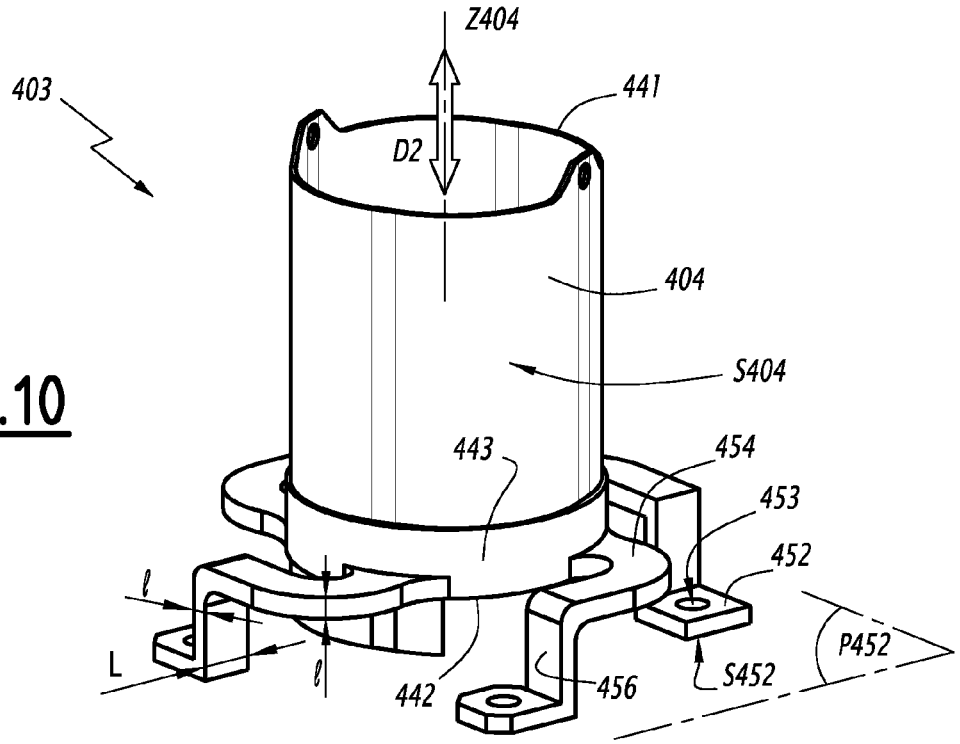
FIGS. 10 and 11 are perspective and plan views of a relay housing according to an example.
Figure 11:
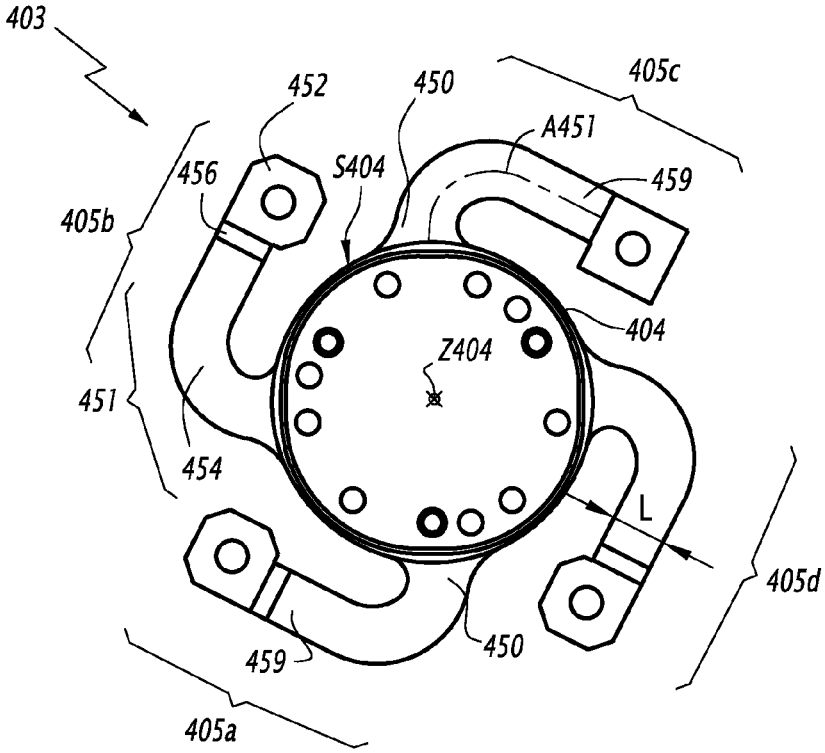

The housing 403 shown in FIGS. 10 and 11 is designed to be fixed to a support, not shown, by means of four fixing elements 405*a*, 405*b*, 405*c* and 405*d* offset angularly by 90° about the axis Z403. At the closed end 442, the external lateral surface S404 of the body 404 includes an annular structural reinforcement 443 forming a protrusion at the periphery of the body 404. The fixing elements 405*a*, 405*b*, 405*c* and 405*d* are connected to the peripheral reinforcement 443 and each includes a connection part 451 and a fixing part 452. The connection parts 451 each connect the periphery reinforcement 443 to the fixing part 452 of the corresponding fixing element 405*a*, 405*b*, 405*c* and 405*d*.

Each fixing element 452 includes a bearing surface S452 designed to be in contact with the support. The bearing surfaces S452 are coplanar and extend in a bearing plane P452 perpendicular to the longitudinal axis Z404 of the body 404. Thus, when the housing 403 is fixed to a horizontal support 406, the axis Z404 is vertical.

Each connection part 451 includes an angled lug 454 as well as a longitudinal branch 456 parallel to the axis Z404. The lugs 454 each connect the structural reinforcement 443 to the corresponding branch 256. Each branch 456 thus connects the corresponding lug 454 to the fixing part 452.

The lugs 454 each extend along a geometric axis A451 forming an elbow, in a plane perpendicular to the axis Z404. Each lug 454 includes a proximal part 450 that is connected to the reinforcement 443 and extends radially outwards, and a distal part 459 connected to the proximal part 450 on the one hand and to the branch 456 on the other. The distal part 459 of each fixing element 405*a*, 405*b*, 405*c* and 405*d* extends in an orthoradial direction, in other words a circumferential direction.

The transverse section of each lug 454, in a plane perpendicular to the axis A451, is roughly rectangular and has two sides of small dimension having a width l, as well as two sides of large dimension having a length L greater than the width l. The width of each section, along the axis A451, is oriented parallel to the axis Z404 and the length L of each section extends in a plane perpendicular to the axis Z404.

The transverse section of each branch 456 is also rectangular, and has two sides of small dimension having a width l, as well as two sides of large dimension having a length L greater than the width l. The width l of each section is oriented in an orthoradial direction and the length L of each section is oriented in a radial direction.

The relay 402 includes at least one movable part, not shown, which, in service, moves in translation on a principal direction D2 parallel to the axis Z404, in both ways.

The geometry of the fixing elements 405*a*, 405*b*, 405*c* and 405*d* is designed to attenuate the transmission of the shocks and/or vibrations between the support and the body 404, in a particular in direction parallel to the principal direction D2 of movement of the movable parts, that is to say a direction parallel to the axis Z404.

This is because the width l of the cross section of the lugs 454 is oriented parallel to the axis Z404 and the length L of the lugs 454 is oriented in a plane perpendicular to the axis Z404 and consequently the lugs 454 deform in flexion, in the direction of the axis Z404, when they are subjected to a force parallel to the axis Z404, in particular to a force resulting from shocks and/or vibrations. The lugs 454 thus dissipate the mechanical energy of the shocks and/or vibrations while preventing the transmission of this energy to the body 404 of the housing 403. In this way the risks of accidental switching of the relay 402 are attenuated.

Figure 12:
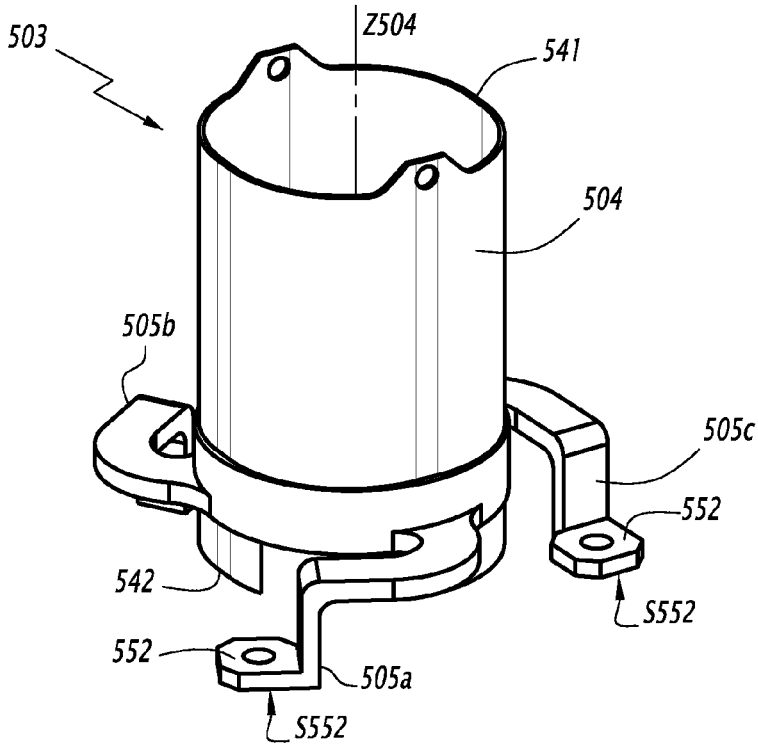
FIGS. 12 and 13 are perspective and plan views of a relay housing according to another example.
Figure 13:
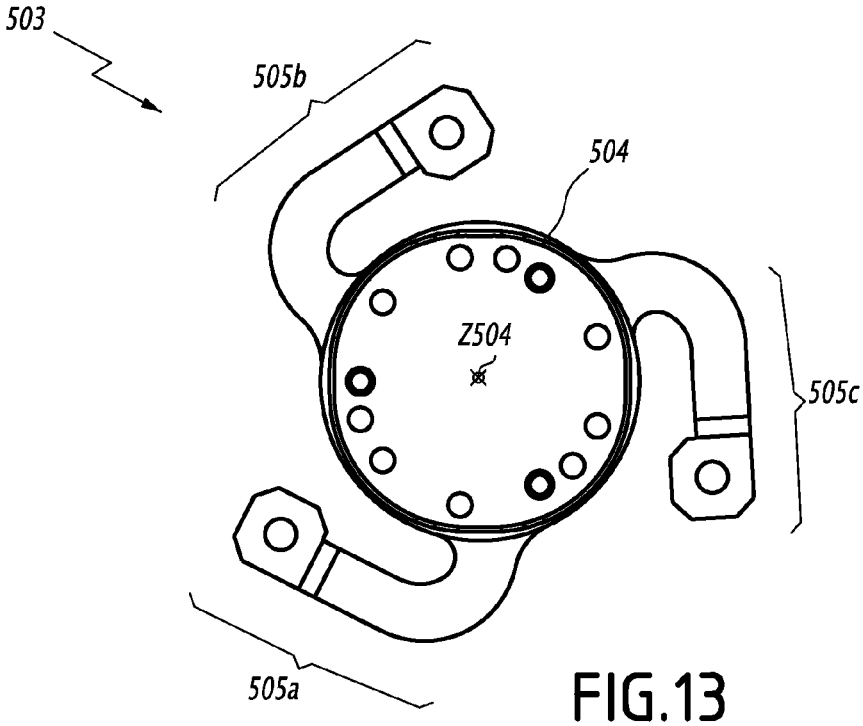

The housing 503 shown in FIGS. 12 and 13 is similar to the housing 403 of FIGS. 10 and 11, except that the housing 503 includes three fixing elements 505*a*, 505*b* and 505*c* instead of four, offset angularly by 120° about the axis Z504 and each connected to the body 504 of the housing 503. The fixing elements 552 have bearing surfaces S552 perpendicular to the axis Z504.

The functioning of the housing 503 is similar to that of the housing 403, the lugs 505*a*, 505*b* and 505*c* being designed to deform in flexion along the axis Z504.

Figure 14:
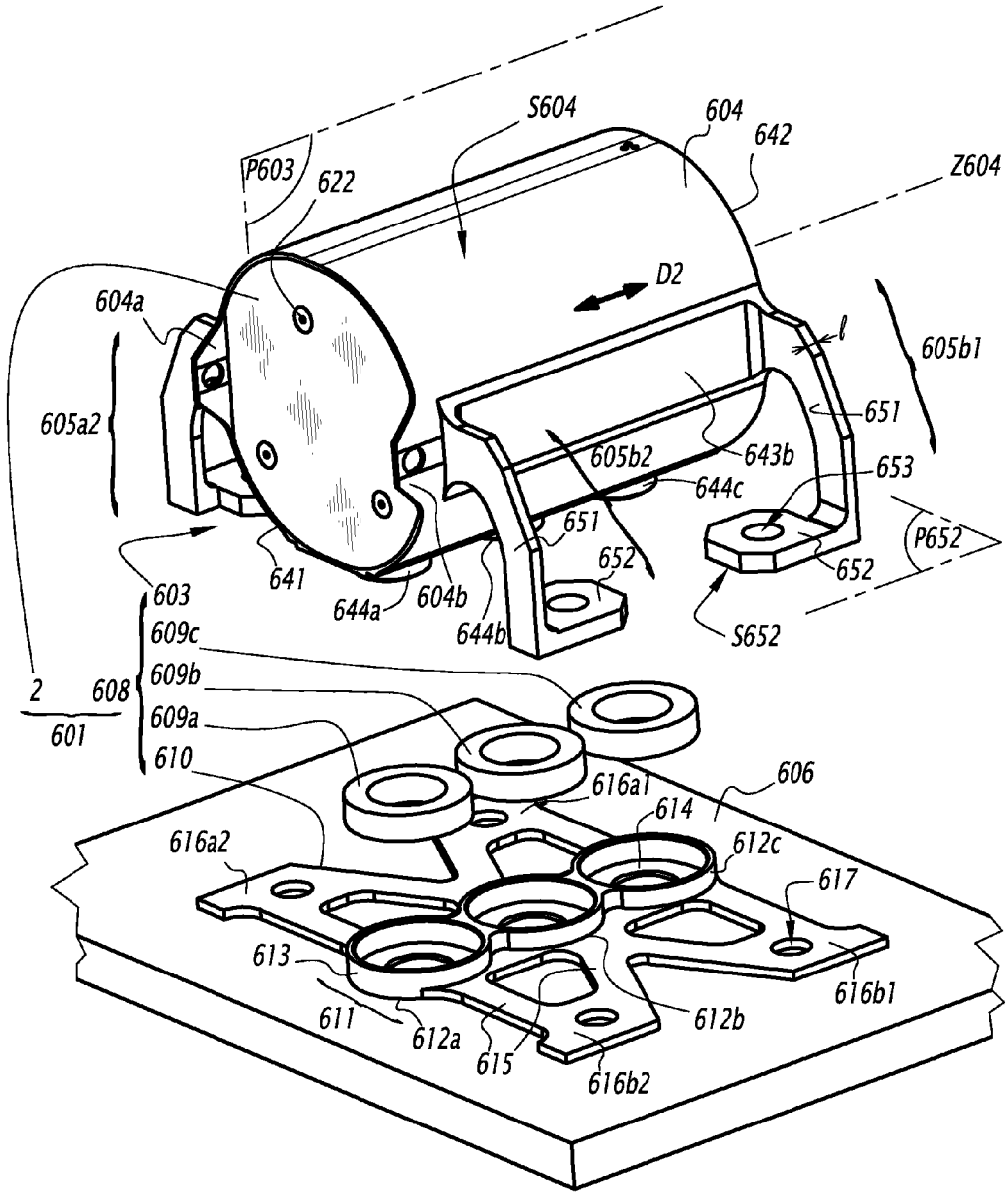
FIGS. 14 and 15 are view in exploded perspective, plan view and view from below of a support assembly according to the invention, fixed to a support.
Figure 15:
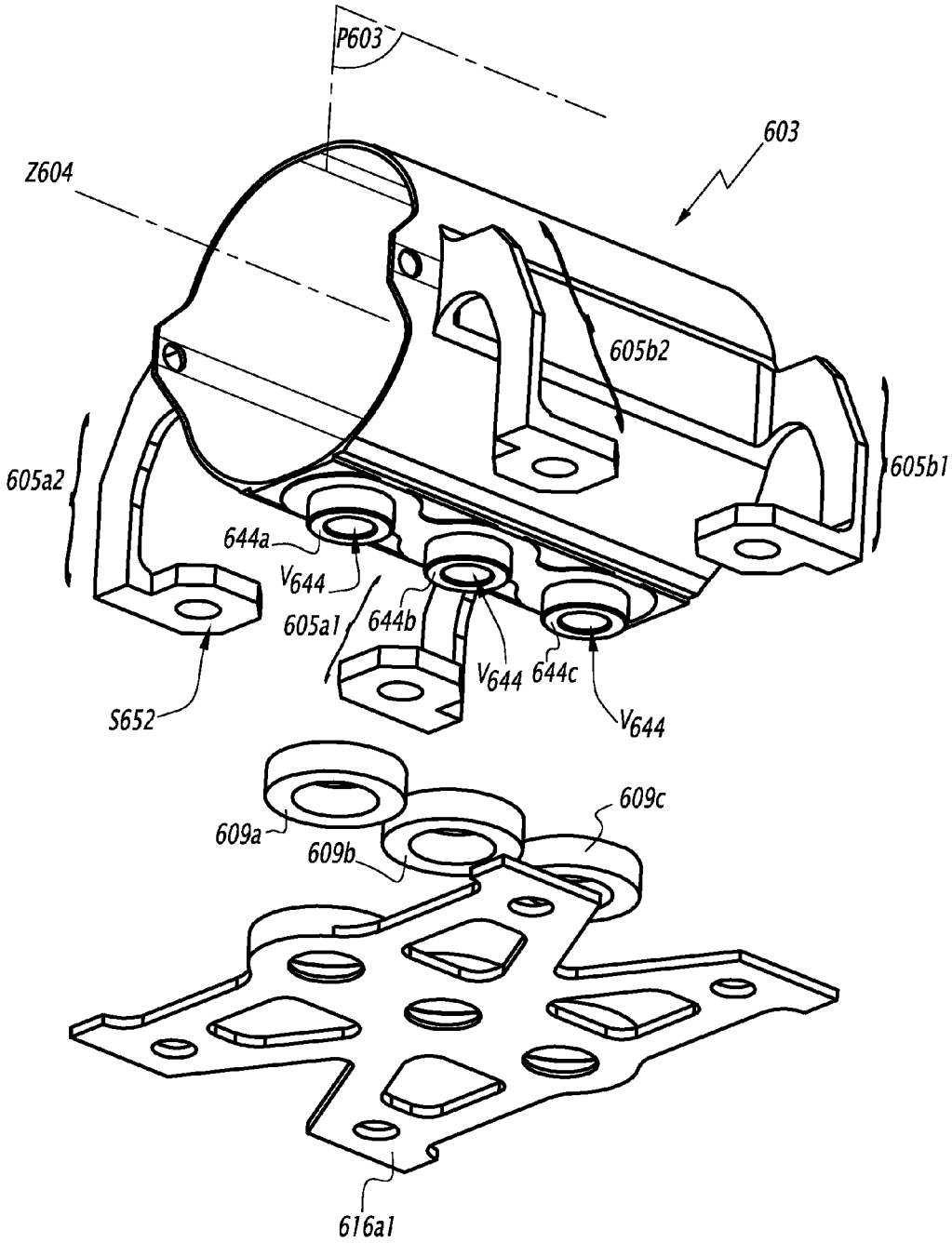
Figure 16:
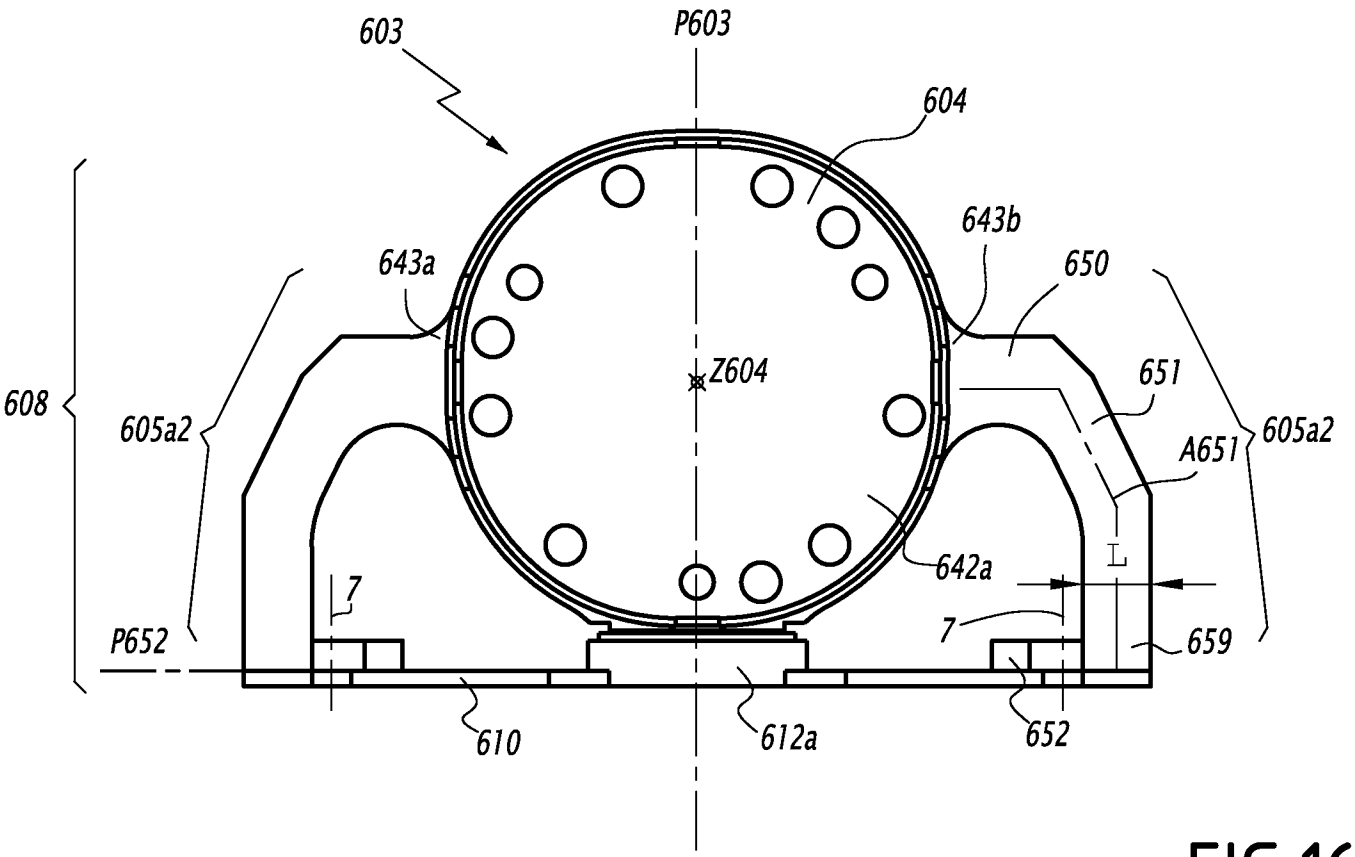
FIG. 16 is a front view of the support assembly of FIGS. 14 and 15.

FIGS. 14 to 16 show an electromechanical relay 601 comprising a support assembly 608 fixed to a support 606, and a switching member 2 shown solely in FIG. 14.

The support assembly 608 includes the housing 603, a base 610 and three damping elements 609*a*, 609*b* and 609*c*, produced from a flexible material that is elastic under the conditions of use of the relay 601, that is to say having a hardness of less than 100 Shore A under these conditions. The damping elements 609*a*, 609*b* and 609*c* are produced from an elastomer such as silicone, optionally with a particle filler.

The housing 603 includes a hollow body 604 inside which the switching member 2 is housed. The body 604 is cylindrical with a circular cross section and extends along a longitudinal geometric axis Z604.

The housing 603 comprise four elements 605*a*1, 605*a*2, 605*b*1 and 605*b*2 for fixing the body 604 to the support 606, similar to the fixing elements 5*a*1, 5*a*2, 5*b*1 and 5*b*2 of the housing 1. Each fixing element 605*a*1, 605*a*2, 605*b*1 and 605*b*2 includes a connection part or lug 651 and a fixing part 652.

The housing 603 is symmetrical with respect to a longitudinal mid-plane P603 that passes through the axis Z604.

The fixing parts 652 each have a flat bearing surface S652 placed on the base 106. The bearing surfaces S652 of the fixing elements 605*a*1, 605*a*2, 605*b*1 and 605*b*2 are in direct contact with the base 610, which rests on the support 606. Consequently the transmission of heat between the housing 603 and the support 606 is optimised, which makes it possible to discharge the heat generated by the switching member 2.

The bearing surfaces S652 are coplanar and extend in a bearing plane P652 perpendicular to the mid-plane P603 and parallel to the axis Z604. Each fixing part 652 includes a central hole 653 for passage of a fixing element 7 such as a screw, represented solely by its axis in FIG. 16. The holes 653 and the screws 7 thus constitute means of fixing the housing 603 to the support 606. When the housing 603 is fixed to a flat horizontal support 606, the axis Z604 of the body 604 extends horizontally.

The lugs 651 each extend along a geometric axis A651 forming an elbow, in a plane perpendicular to the axis Z604. Each lug 651 includes a proximal part 650 that is connected to the end of one of the reinforcements 643*a* or 643*b* and extends laterally outwards, perpendicular to the mid-plane P603, as well as a distal part 659 connected to the proximal part 650 on the one hand and to the fixing part 652 on the other. The distal part 659 of each fixing element 605*a*1, 605*a*2, 605*b*1 and 605*b*2 extends perpendicular to the bearing plane P652.

The transverse section of each lug 651, in a plane perpendicular to the axis A651, is roughly rectangular and has two sides of small dimension having a width l as well as two sides of large dimension having a length L greater than the width l. The width l of each section, along the axis A651, is oriented parallel to the axis Z604 and the length L of each section extends in a plane perpendicular to the axis Z604. These lengths L and l may vary along the lug 651 so as to distribute the mechanical forces undergone during deformation.

At the intersection between the bearing plane P652 and the longitudinal plane P603, the external surface 5604 of the body 604 of the housing 603 is provided with three studs 644*a*, 644*b* and 644*c* with a circular cross section, aligned with each other parallel to the axis Z604 and projecting downwards, in the direction of the support 606. The studs 644*a*, 644*b* and 644*c* are identical, but in a variant they may be different.

Optionally, the central part of each stud 644*a*, 644*b* and 644*c* is hollowed out, in order in particular to reduce the mass of the housing 603, and defines a hollow volume $V_{644}$.

Each damping element 609*a*, 609*b* and 609*c* is in the form of a ring, the inside diameter of which is substantially equal to the outside diameter of the studs 644*a*, 644*b* and 644*c*. The damping elements 609*a*, 609*b* and 609*c* are thus fitted respectively on the studs 644*a*, 644*b* and 644*c*, with a small functional clearance.

The base 610 is roughly flat, extends roughly in the bearing plane P652 and rests flat on the support 606. The base 610 is produced from a rigid metal material such as an aluminium alloy. The base 610 includes a central longitudinal part 611, provided with three circular supports 612*a*, 612*b* and 612*c* each comprising a circular lateral wall 613, perpendicular to the bearing plane P652, and a bottom 614 parallel to the bearing plane P652. The supports 612*a*, 612*b* and 612*c* are aligned with each other parallel to the axis Z604, facing the studs 644*a*, 644*b* and 644*c*. The inside diameter of the lateral walls 613 is substantially equal to the outside diameter of the damping elements 609*a*, 609*b* and 609*c*, which are disposed respectively against the bottom 614 of the supports 612*a*, 612*b* and 612*c*, inside the supports 612*a*, 612*b* and 612*c*, with a small functional clearance. According to a new-shown alternative, supports 612*a*, 612*b* and 612*c* may not be aligned with each other parallel to the axis Z604.

The base 610 includes several branches 615 that extend laterally from the central part 611 and connect it to four fixing lugs 616*a*1, 616*a*2, 616*b*1 and 616*b*2 each including a hole 617. Thus empty areas are delimited between the branches 615, which is particularly advantageous for fields of application where the mass must be minimal, such as for example aerospace. In a variant, the base 610 is solid.

The bearing surfaces S652 of the housing 603 rest against the lugs 616*a*1, 616*a*2, 616*b*1 and 616*b*2 of the base 610. Each fixing element also passes through one of the holes 617 of the base 610 of the support 606. The holes 617 and the fixing elements 7 constitute means of fixing the base 610 to the support 606. The base 610 is interposed between, and in contact with, the bearing surface S652 of the housing 603 and the support 606.

Each damping element 609*a*, 609*b* and 609*c* is locked in translation downwards by the bottom 614 of the supports 612*a*, 612*b* and 612*c*, upwards by the external lateral surface S604 of the body 604 of the housing 603 and on the sides by the lateral wall 613 of the supports 612*a*, 612*b* and 612*c*.

The geometry of the fixing elements 605*a*1, 605*a*2, 605*b*1 and 605*b*2 is designed to attenuate the transmission of shocks and/or vibrations between the support 606 and the body 604, in particular on the principal axis D2, that is to say parallel to the axis Z604. The lugs 651 thus dissipate the mechanical energy of the shocks and/or vibrations, reducing the transmission of this energy to the body 604 of the housing 603. In this way the risks of accidental switching of the switching member 2 are attenuated.

The lugs 651 essentially damp the effects of the shocks but their elasticity has a tendency to generate high vibratory resonances, in particular at low frequencies. The damping elements 609*a*, 609*b* and 609*c*, for their part, effect a viscous and elastic damping, particularly effective for low vibration frequencies, which attenuates the vibratory resonances generated by the lugs 651.

When the housing 603 moves with respect to the support 606 on the principal axis D2 under the action of shocks and/or vibrations, in one direction or the other, the studs 644*a*, 644*b* and 644*c* compress the damping elements 609*a*, 609*b* and 609*c* against the lateral walls 613 of the supports 612*a*, 612*b* and 612*c*. The damping elements 609*a*, 609*b* and 609*c* are stressed mechanically mainly in compression, which dissipates the energy generated by the shocks and/or vibrations, in particular at low frequencies.

In this way the lugs 651 and the damping elements 609*a*, 609*b* and 609*c* effect together an effective damping of the shocks and vibrations, which effectively reduces the risks of accidental switching of the switching member 2.

FIGS. 17 to 22 illustrate support assemblies 708, 808 and 908 that compress the damping elements, also produced from a flexible material elastic under the conditions of use of an electromagnetic relay, which includes one of these assemblies.

Figure 17:
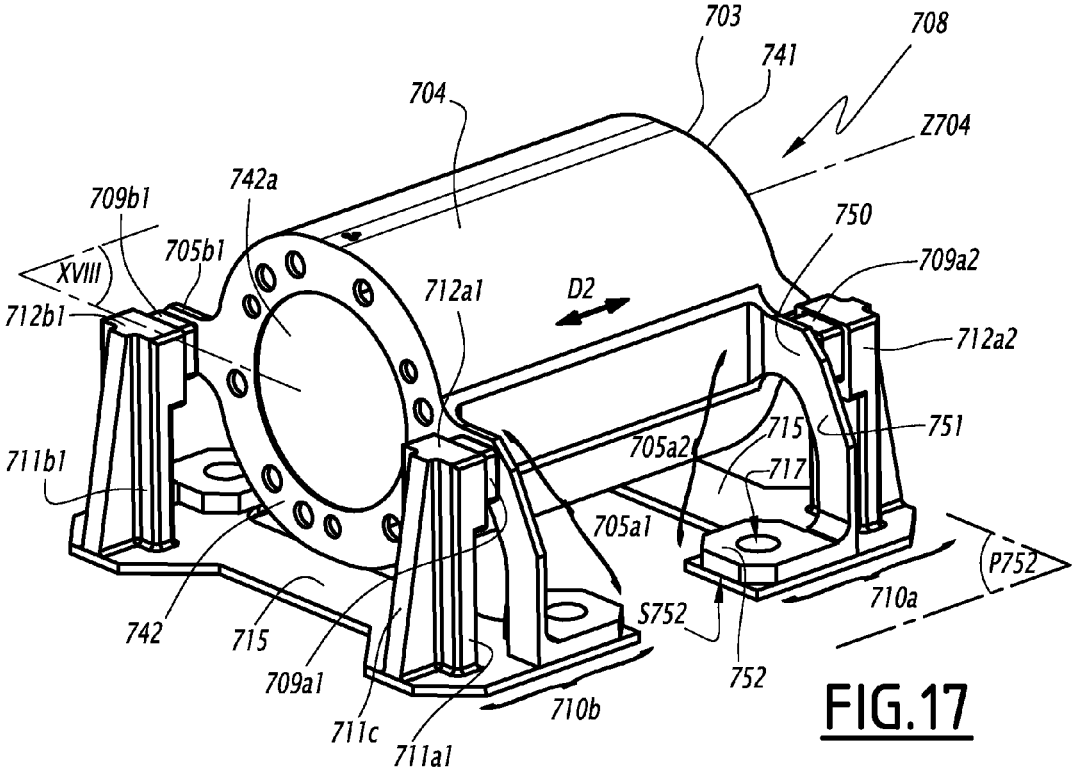
FIG. 17 is a perspective view of a support assembly according to a another example of the invention.
Figure 18:
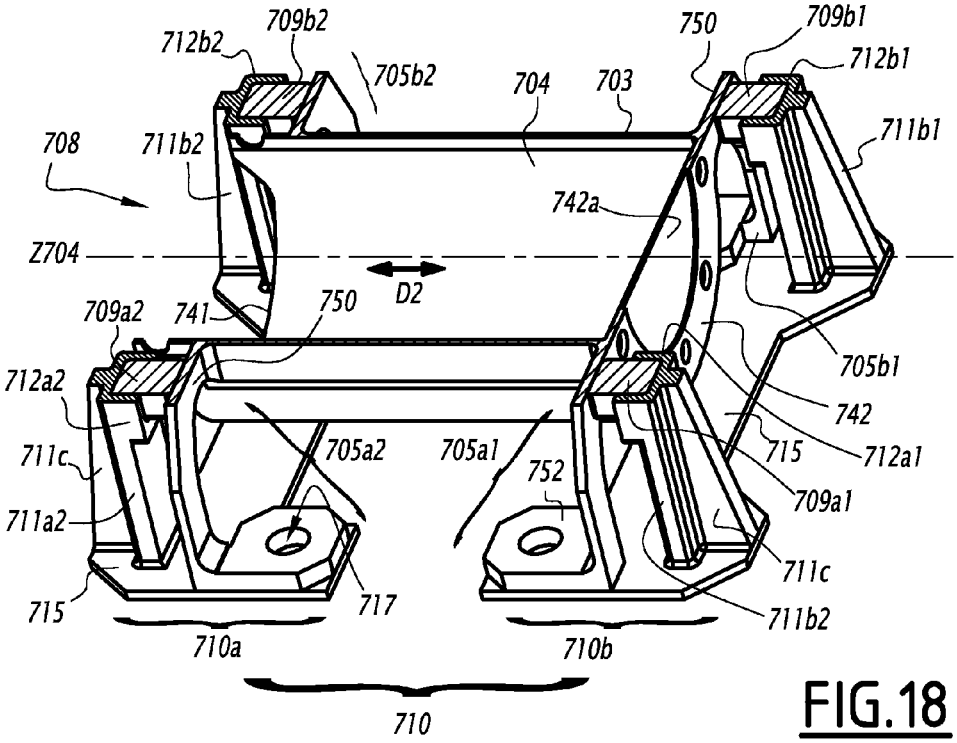
FIG. 18 is a partial perspective view of the support assembly of FIG. 17, cut along the plane XVIII.

The housing 703 of the support assembly 708 shown in FIGS. 17 and 18 is similar to the housing 603. The support assembly 708 includes four parallelepipedal damping elements 709*a*1, 709*b*1, 709*a*2 and 709*b*2, as well as a base 710 comprising two separate rigid parts 710*a* and 710*b*, of similar geometry.

The first part 710*a* of the base 710 is disposed level with the fixing elements 705*a*2 and 705*b*2 and on the same side as the open end 741 of the body 704 of the housing 703, while the second part 710*b* of the base 710 is disposed level with the fixing elements 705*a*1 and 705*b*1 on the same side as the closed element 742.

Each part 710*a* and 710*b* includes a flat plate 715, extending in the bearing plane P752 and on which the bearing surfaces S752 of the fixing elements 705*a*1, 705*a*2, 705*b*1 and 705*b*2 rest. Each part 710*a* and 710*b* includes two holes 717 for passage of the fixing elements 7. The part 710*a* of the base 710 is provided with two uprights 711*a*2 and 711*b*2. The part 710*b* of the base 710 is provided with two other uprights 711*a*1 and 711*b*1. The uprights 711*a*1, 711*a*2, 711*b*1 and 711*b*2 are perpendicular to the plate 715 and each includes a reinforcing rib 711*c* for increasing the bending strength of the uprights along the axis Z704.

The top of each upright 711*a*1, 711*a*2, 711*b*1 and 711*b*2 includes a hollow support 712*a*1, 712*a*2, 712*b*1 and 712*b*2, in which a damping element 709*a*1, 709*a*2, 709*b*1 or 709*b*2 is disposed. The depth of the supports 712*a*1, 712*a*2, 712*b*1 and 712*b*2 is determined so that part of each damping element projects outside its support.

The damping elements 709*a*1, 709*a*2, 709*b*1 or 709*b*2 are situated outside the space delimited the fixing elements 705*a*1 and 705*b*1 on the one hand and 705*a*2 and 705*b*2 on the other hand.

The supports 712*a*1, 712*a*2, 712*b*1 and 712*b*2 are open in the direction of one of the ends 741 or 742 of the housing 703 so that the damping elements 709*a*1, 709*a*2, 709*b*1 and 709*b*2 each come into contact with the proximal part 750 of one of the fixing parts 705*a*1, 705*a*2, 705*b*1 or 705*b*2 of the housing 703.

The function of the housing 703 is similar to that of the housing 603, the lugs 705*a*1, 705*a*2, 705*b*1 and 705*b*2 being designed so as to deform in flexion along the axis Z704.

The damping elements 709*a*2 and 709*b*2 supported by the first part 710*a* of the base 710 damp the vibrations of the body 704 of the housing 703, in a first way of the principal direction D2, namely towards the right in FIG. 17, while the damping elements 709*a*1 and 709*a*2 damp the vibrations of the body 704 in the other way of the principal direction D2, namely towards the left in this figure.

Figure 19:
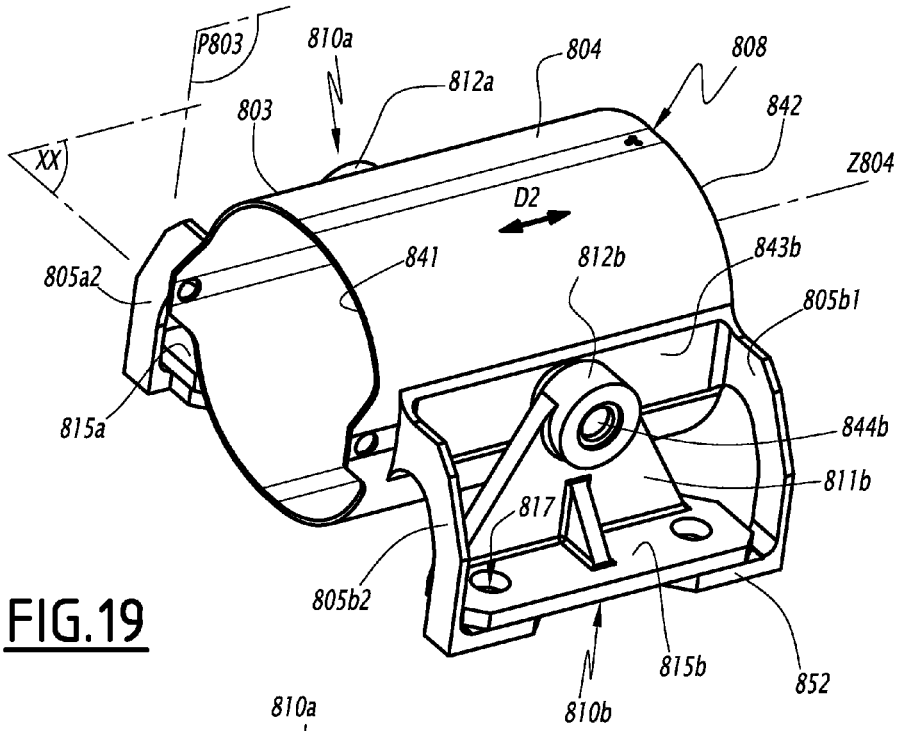
FIG. 19 is a perspective view of a support assembly according to a further example.
Figure 20:
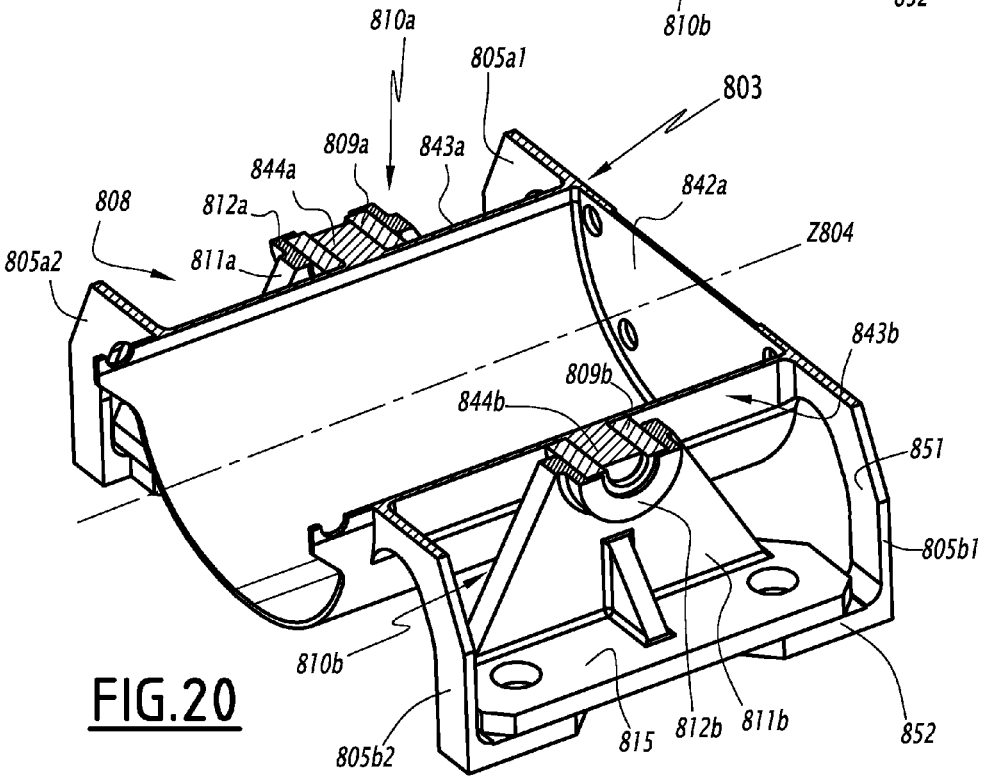
FIG. 20 is a partial perspective view of the support assembly of FIG. 17, cut along the plan XX.

The support assembly 808 shown in FIGS. 19 and 20 includes a housing 803 that is distinguished from the housing 603 by the presence of two lateral studs 844*a* and 844*b* situated at the middle of the structural reinforcements 843*a* and 843*b* of the body 804 and projecting, with respect to the housing 803, perpendicular to a longitudinal plane P803 of the housing 803. An annular damping element 809*a* or 809*b* is fitted one each of the studs 844*a* and 844*b*.

The support assembly 808 includes two rigid bearings 810*a* and 810*b* disposed laterally on either side of the body 804 of the housing 803. The bearing 810*a* extends between the fixing elements 805*a*1 and 805*a*2 of the housing 803, while the bearing 810*b* extends between the fixing elements 805*b*1 and 805*b*2.

Each bearing 810*a* and 801*b* includes a flat plate 815*a* or 815*b* that rests on the fixing parts 852 of the fixing elements 805*a*1 and 805*a*2 or 805*b*1 and 805*b*2 of the housing 803.

Each bearing 810*a* and 810*b* includes a vertical wall 811*a* or 811*b* that connects the plate 815*a* or 815*b* to a support 812*a* or 812*b*. The damping elements 809*a* and 809*b* are each received in one of the supports 812*a* and 812*b* and part of the damping elements 809*a* and 809*b* projects outside the supports 812*a* and 812*b* and comes into contact with the reinforcements 843*a* and 843*b* of the housing 803.

The plate 815*a* or 815*b* of each bearing 810*a* and 810*b* includes two holes 817 for passage of the fixing elements 7.

The functioning of the housing 803 is similar to that of the housing 603, the lugs 805*a*1, 805*a*2, 805*b*1 and 805*b*2 being designed to deform in flexion along the axis Z804.

The damping elements 809*a* and 809*b* damp the vibrations of the body 804 of the housing 803 on the principal direction D2 and in both ways.

Figure 21:
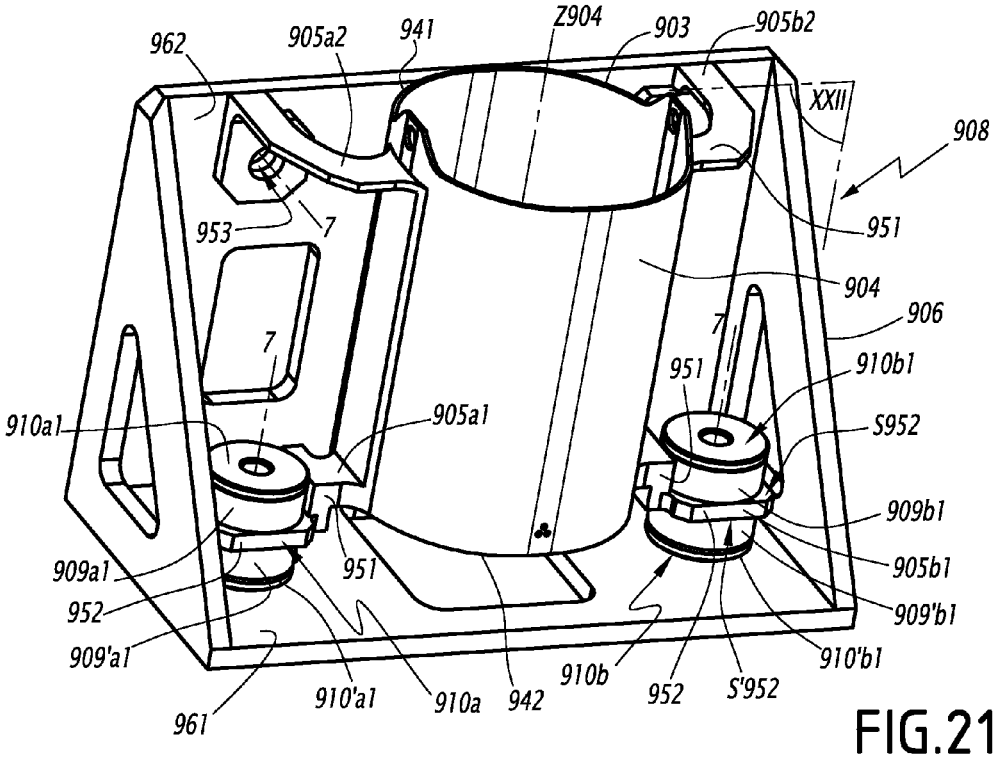
FIG. 21 is a perspective view of a support assembly according to a yet further example of the invention.
Figure 22:
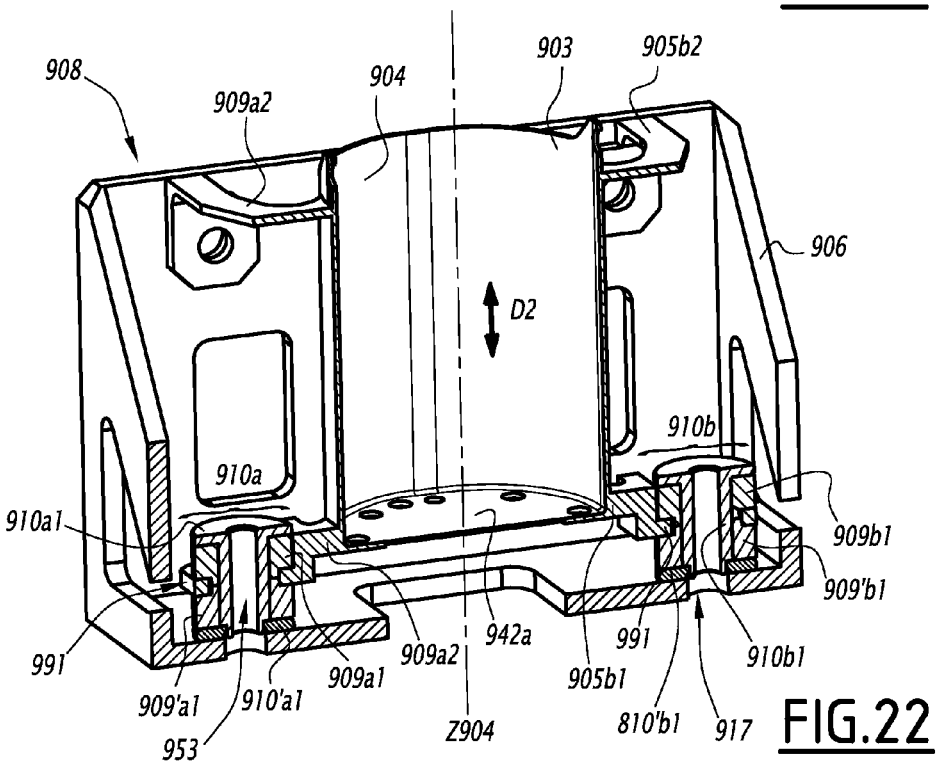
FIG. 22 is a partial perspective view of the support assembly of FIG. 21, cut along the plane XXII.

The support assembly 908 in FIGS. 21 and 22 is distinguished in particular from the support assemblies 608, 708 and 808 by the orientation of the axis Z904 of the housing 904 and of the principal direction D2, which are vertical in service.

The housing 903 includes four fixing elements 905*a*1, 905*a*2, 905*b*1 and 905*b*2. The fixing elements 905*a*2 and 905*b*2 are identical to the fixing elements 605*a*2 and 605*b*2 of the housing 603. The fixing elements 905*a*1 and 905*b*1 each comprise a connection part 951 that is relatively short and solid, with respect to the fixing elements 905*a*2 and 905*b*2, as well as a fixing part 952 that includes two opposite bearing surfaces S952 and S'952 perpendicular to the axis Z904.

The housing 903 is fixed to a support 906 that includes a horizontal wall 961 and a vertical wall 962, both perpendicular. The lugs 905*a*2 and 905*b*2 of the housing 903 are in abutment against the vertical wall 962. Fixing elements 7, such as screws, are used to fix these lugs 905*a*2 and 905*b*2 to the support 906.

The lugs 905*a*1 and 905*b*1 are each fixed to the horizontal wall 961 of the support 906 by means of a damping assembly or silent block 910*a* or 910*b*, which includes two damping elements 909*a*1 and 909'*a*1 or 909*b*1 and 909'*b*1, annular in shape, as well as a rigid support formed firstly by a first tubular piece 910*a*1 or 910*b*1 one end of which is extended by a collar, and secondly by a washer 910'*a*1 or 910'*b*1 that comes into abutment against the end of the tubular piece 910*a*1 or 910*b*1 opposite to the collar.

Additional fixing elements 7 such as screws are used to fix the lugs 905*a*1 and 905*b*1 and the silent blocks 910*a* and 910*b* to the support 906. The fixing elements 7 pass through the pieces 910*a*1, 910'*a*1, 910*b*1 and 910'*b*1, through the holes 953 in the fixing elements 905*a*1 and 905*b*1 and through holes 917 produced in the support 906.

The damping elements 909*a*1, 909'*a*1, 909*b*1 and 909'*b*1 of each silent block 910*a* and 910*b* are disposed on either side, along the principal direction D2, of the fixing part 952 of the fixing elements 905*a*1 and 905*b*1. Each damping element 909*a*1, 909'*a*1, 909*b*1 and 909'*b*1 includes a peripheral groove 991 which, when the two damping elements are stacked, form a slot inside which the periphery of the hole 953 of the fixing part 952 extends.

The damping elements 909*a*1 and 909'*a*1 on the one hand and 909*b*1 and 909'*b*1 on the other hand are locked between the collar of the of the first piece 910*a*1 or 910*b*1 and the washer 910'*a*1 or 910'*b*1 of the silent blocks 910*a* and 910*b*.

The functioning of the housing 903 is similar to the that of the housing 3, the lugs 905*a*2 and 905*b*2 having been designed to deform in flexion along the axis Z904.

The damping elements 909*a*1, 909'*a*1, 909*b*1 and 909'*b*1 damp the vibrations along the principal direction D2, in both ways.

When the housing 903 has a tendency to move downwards, in the direction of the horizontal wall 961 of the support 906, the damping elements 909'*a*1 and 909'*b*1 are compressed by the fixing parts 952 and come into abutment against the washers 910'*a*1 and 910'*b*1.

When the housing 903 has a tendency to move upwards, opposite to the horizontal wall 961 of the support 906, the damping elements 909*a*1 and 909*b*1 are compressed by the fixing parts 952 and come into abutment against the collar of the first pieces 910*a*1 and 910*b*1.

In a variant, not shown, of the housing 603 of FIGS. 14 to 16, the fixing elements are not distributed symmetrically with respect to the longitudinal mid-plane P603. For example, the housing may comprise only three fixing elements, one of which is situated on a first side of the plane P603 and the other two on the other side.

The housings 3, 103, 203, 303, 403, 503, 603, 703, 803 and 903 are monolithic, that is to say formed in a single piece. The housings can be manufactured for example by machining a block of material. No additional piece is required to effect the damping of the shocks and vibrations, which simplifies their manufacture and increases their reliability and service life.

By way of example, the housings 3, 103, 203, 303, 403, 503, 603, 703, 803 and 903 are produced from an aluminium alloy having satisfactory mechanical characteristics. As an alternative, the housings can be produced with a titanium alloy or a beryllium copper ($CuBe_2$) or with a steel. Optionally, the material chosen may incorporate carbon fibres.

In a variant that is not shown, the body 4, the lugs 51 and/or the fixing parts 52 are produced from separate pieces that are then assembled together, for example by adhesive bonding, welding or screwing.

In a variant that is not shown, the body 4 is a cylinder having any cross section, for example prismatic. The body 4 may also not be cylindrical.

In a variant, the movable parts of the switching member 2 move along a principal direction that is not parallel to the longitudinal axis Z4 of the body 4 of the housing 3, for example a direction perpendicular to the longitudinal axis Z4. In this case, the lugs 51 are designed to deform in flexion in the direction of movement of the movable parts. The lugs 51 then have a low rigidity in this movement direction and a greater rigidity in a direction perpendicular to the direction of movement.

In a variant that is not shown, the transverse section of the lugs 51 is not rectangular and has a cross section having a geometry designed to deform in flexion at least along the principal direction D2, such as a cross section of elongate shape.

In a variant that is not shown, the fixing elements of the housings 203, 303, 403 and 503 are not distributed angularly in a uniform manner over the circumference of the housing.

In the context of the invention, the technical features of the embodiments described may be combined together, at least partially.

The invention claimed is:

1. A housing for an electromechanical relay, the relay comprising a switching member including pieces for switching electrical contacts, movable in translation on a principal direction, the housing comprising:

a hollow body receiving the switching member, a plurality of elements fixing the body to a support, the fixing elements each comprising:

a fixing part comprising a surface bearing on the support;

a unit permitting fixing to the support, and a connection part connecting the fixing part to the body wherein the connection part is designed to deform in flexion at least on the principal direction.

2. The housing according to claim 1, wherein the body is cylindrical and extends along a longitudinal axis parallel to the principal direction.

3. The housing according to claim 1, wherein the body is cylindrical and extends along a longitudinal axis perpendicular to the principal direction.

4. The housing according to claim 1, wherein the body is monolithic, the body and the fixing elements being formed in a single piece.

5. The housing according to claim 1, wherein the body is cylindrical and extends along a longitudinal axis and wherein the bearing surfaces of the fixing parts are parallel to the longitudinal axis of the body.

6. The housing according to claim 1, wherein the body is cylindrical and extends along a longitudinal axis and wherein the bearing surfaces of the fixing parts are perpendicular to the longitudinal axis of the body.

7. The housing according to claim 1, wherein the transverse section of at least one portion of the connection part of each fixing element is elongate in shape and has a width, measured parallel to the principal direction, less than the length of this transverse section.

8. The housing according to claim 1, wherein the housing comprises:

a first fixing element extending from a first side of a mid-plane of the body, and two second fixing elements situated opposite to the first fixing element with respect to the mid-plane;

wherein a maximum width of the first fixing element is less than a minimum distance between the second fixing elements.

9. An electromagnetic relay, comprising a switching member housed in a housing according to claim 1.

10. A switching assembly, comprising several housings according to claim 8 and wherein the housings are fixed to a support so that the first fixing element of a first housing is placed between the second fixing elements of an adjacent second housing.

11. An assembly supporting an electromagnetic relay, wherein the support assembly comprises a housing according to claim 1, and wherein the support assembly further comprises at least one element damping shocks and vibrations of the body of the housing with respect to the support, produced from an elastomer.

12. The support assembly according to claim 11, wherein the damping element is stressed mechanically in compression when the body of the housing moves with respect to the support along the principal direction.

13. The support assembly according to claim 11, wherein a rigid element is interposed between the damping element and the support.

14. The support assembly according to claim 13, wherein the rigid element is interposed between the bearing surface of the fixing elements and the support.

15. The support assembly according to claim 12, wherein the rigid element comprises at least one hollow support in which the damping element is disposed.

* * * * *